US006102689A

United States Patent [19]

Man

[11] Patent Number: 6,102,689

[45] Date of Patent: Aug. 15, 2000

[54] PUSH BUTTON SAFETY LIGHTER

[76] Inventor: Aman Chung Kai Man, Unit 1, 11/F, Wah Lai Ind. Centre, 10-14 Kwei Tei Street, Fo Tan, Shatin, N.T., The Hong Kong Special Administrative Region of the People's Republic of China

[21] Appl. No.: 09/201,418

[22] Filed: Sep. 29, 1998

[51] Int. Cl.[7] ..... F23D 11/36

[52] U.S. Cl. ..... 431/153; 431/277

[58] Field of Search ..... 431/153, 277, 431/255

[56] References Cited

U.S. PATENT DOCUMENTS

| | | | |
|---|---|---|---|
| 3,749,286 | 7/1973 | Douglas . | |
| 3,828,982 | 8/1974 | Steigerwald . | |
| 3,918,614 | 11/1975 | Steiman . | |
| 4,784,602 | 11/1988 | Nitta . | |
| 4,830,603 | 5/1989 | Cirami . | |
| 5,002,482 | 3/1991 | Fairbanks et al. . | |
| 5,066,220 | 11/1991 | Vick . | |
| 5,074,781 | 12/1991 | Fujita . | |
| 5,090,893 | 2/1992 | Floriot . | |
| 5,120,215 | 6/1992 | Amoros Nollas . | |
| 5,125,829 | 6/1992 | McDonough et al. . | |
| 5,165,886 | 11/1992 | Frigiere | 431/153 |
| 5,184,948 | 2/1993 | Iwahori . | |
| 5,186,618 | 2/1993 | Shike et al. | 431/153 |
| 5,205,729 | 4/1993 | Iwahori | 431/153 |
| 5,213,493 | 5/1993 | Iwahori . | |
| 5,350,294 | 9/1994 | Iwahori . | |
| 5,378,143 | 1/1995 | Ansquer . | |
| 5,407,346 | 4/1995 | Sher . | |
| 5,421,720 | 6/1995 | Sher . | |
| 5,437,549 | 8/1995 | Saito | 431/153 |
| 5,472,338 | 12/1995 | Ansquer | 431/153 |
| 5,492,468 | 2/1996 | Cirami . | |

FOREIGN PATENT DOCUMENTS

| | | |
|---|---|---|
| 1330166 | 6/1994 | Canada . |
| 0479318A2 | 4/1992 | European Pat. Off. . |
| 0357347B1 | 11/1993 | European Pat. Off. . |
| 2633702 | 7/1988 | France . |
| 2210552 | 9/1973 | Germany . |

*Primary Examiner*—Carl D. Price
*Attorney, Agent, or Firm*—Trojan Law Offices

[57] ABSTRACT

A child resistant lighter comprising a standard lighter construction having a main body, a fuel reservoir, a valve, a valve release means, and a spark wheel assembly, the improvement comprising a locking push button safety device, having an initial and an engaged position, such that in said initial position said valve release means is blocked from opening said valve, and in said engaged position said valve release means is free to be operated to open said valve, and said push button being configured to automatically return to its initial position after operation of said valve release means, therefore by requiring sufficient physical strength and dexterity to operate the push button and by adding additional operational steps, the push button safety device Should hinder or prevent use of the lighter by children or others who don't appreciate the dangers of fire.

8 Claims, 4 Drawing Sheets

PUSH BUTTON SAFETY LIGHTER

FIELD TO THE INVENTION

This invention relates to child-resistant lighters.

BACKGROUND OF THE INVENTION

Various prior art cigarette lighter; incorporating safety features are known. Safety features are generally provided to reduce the risk of injury to an operator or bystanders. Safety features for cigarette lighters can be divided into several general categories. Some safety mechanisms prevent ignition of a fuel source unless the lighter is properly oriented. Other mechanisms have been designed to automatically turn off a fuel supply valve. More recently, attention has been directed toward preventing ignition of the lighters by children and other persons normally not able to appreciate the danger of fire. Individuals usually considered in these efforts are young children, age five years and younger.

Some safety mechanisms are designed to prevent children from operating the lighter by blocking movement of the thumb pad or lever typically found in these types of lighters. This block has been carried out by various means. Each of these means have obtained varied levels of success in preventing operation by children.

One method of moving this block in and out of position has been to slide the block substantially horizontally relative to the thumb pad. This way the block is moved to a second position such that the block no longer makes contact with any portion of the thumb pad when the thumb pad is depressed.

However, few of the prior inventions have accomplished this block movement by use of a sliding and locking push button which automatically returns to its initial position. The present invention operates by utilizing a substantially horizontally sliding and locking button employing a retention means which directly receives the slidable block. Most prior art devices employing a sliding block require the user to manually lock the push button by performing vertical as well horizontal movements. Those prior art devices wherein the push button's movement is solely horizontal do not lock the push button in place by use of a retention means which directly receives the slidable block. This invention's push button safety device reduces the potential for use by children by requiring the user to understand the device's method of operation and to be able to apply sufficient force to the push button.

SUMMARY OF THE INVENTION

The present invention is directed to a child-resistant lighter. The lighter has a safety push button which must be fully engaged before the lighter may be operated. This push button is fixed to a slidable block which can move into and out of the operational pathway of the lighter's release lever. When the push button is not engaged the block is positioned to prevent the release lever from being deflected enough to actuate the valve and release fuel. As such, without the push button being engaged the strike wheel may be turned and sparks created but ignition can not occur as the blocked release level prevents fuel from being dispensed, However, when the push button is engaged, the block is slid out of the pathway of the release level and it may then sufficiently deflect to operate the valve and release fuel. The push button safety device also utilizes a locking mechanism which receives and retains the block such that once the push button has been engaged it will remain so until the lighter is operated. Finally a resilience means is incorporated into the design so that after operation of the lighter, whether ignition occurs or not, the push button and the block attached thereto return to their respective initial positions. A child is prevented or hindered in its use of the lighter as the child may not have the strength and/or manual dexterity necessary to effectively operate the push button safety device.

Likewise, the invention is intended to add additional analytical steps to the child's mental process of understanding the operation of the lighter to further hinder the ability of small children to use the lighter.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which.

DETAILED DESCRIPTION OF PREFERRED EMBODIMENT

Figure 1:
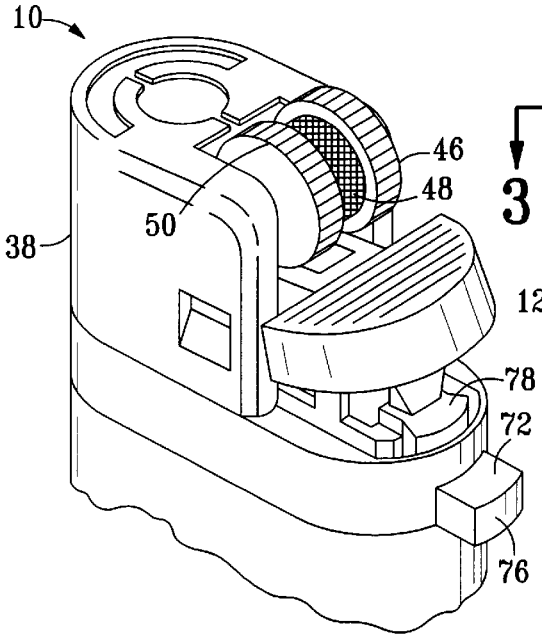
FIG. 1 is a perspective view of the invention.
Figure 2:
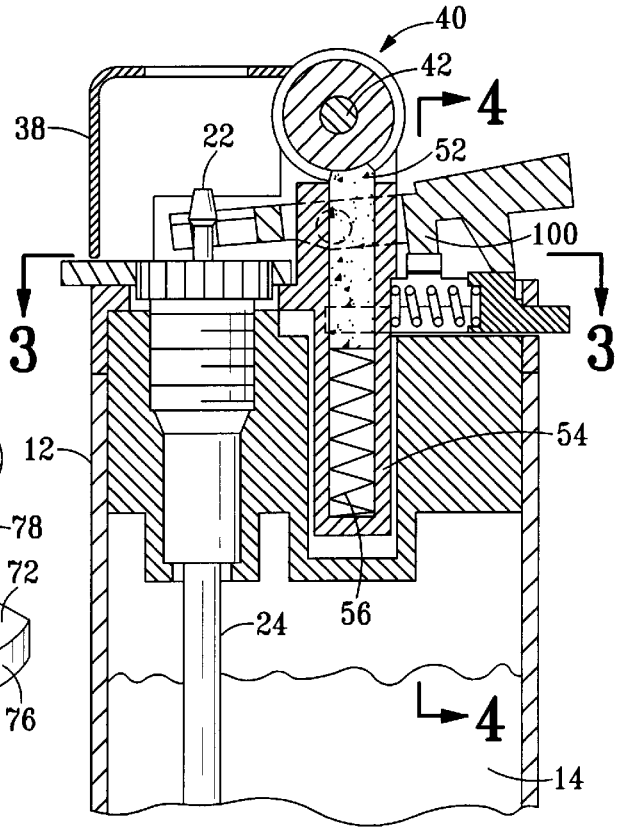
FIG. 2 is a side cross-sectional view of the invention with the push button safety device in its non-engaged position such that the the block is positioned in the pathway of the release arm so as to prohibit operational movement of the release arm.
Figure 4:
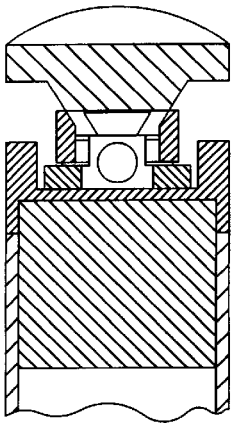
FIG. 4 is a front cross-sectional view of the invention with the release arm in its initial position, the push button safety device in its non-engaged position, and the block positioned in the pathway of the release arm so as to prohibit operational movement of the release arm.
Figure 3:
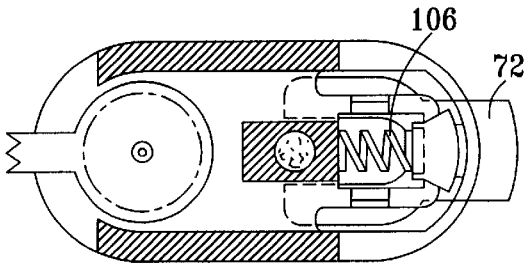
FIG. 3 is a top cross-sectional view of the invention with the push button safety device in its non-engaged position, and the block positioned in the pathway of the release arm.
Figure 5:
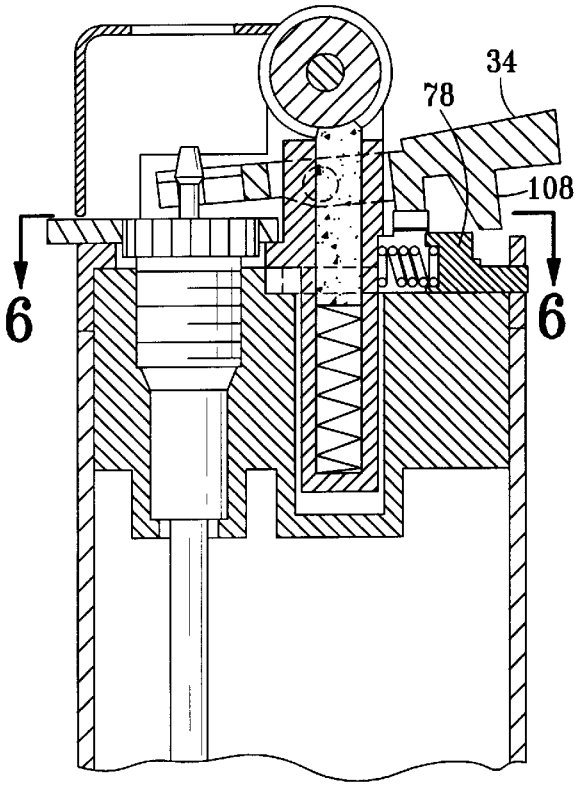
FIG. 5 is a side cross-sectional view of the invention showing the push button safety device engaged and the release lever in its initial position.
Figure 7:
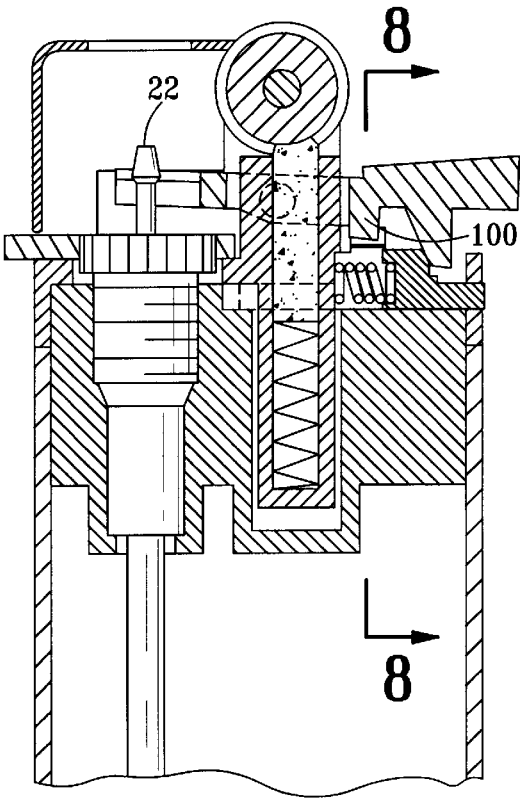
FIG. 7 is a side cross-sectional view of the invention showing the push button safety device engaged with the release lever in its operating position antis the valve in an open position.
Figure 6:
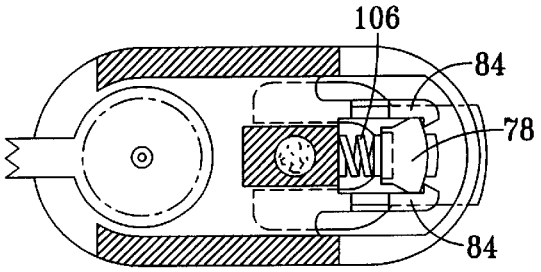
FIG. 6 is a top cross-sectional view of the invention showing the retention means receiving the block.
Figure 8:
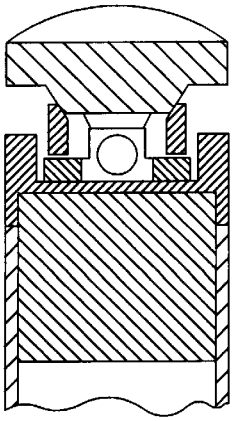
FIG. 8 is a front cross-sectional view of the invention showing the retention means being actuated by the release level so as to released the receive block.
Figure 9:
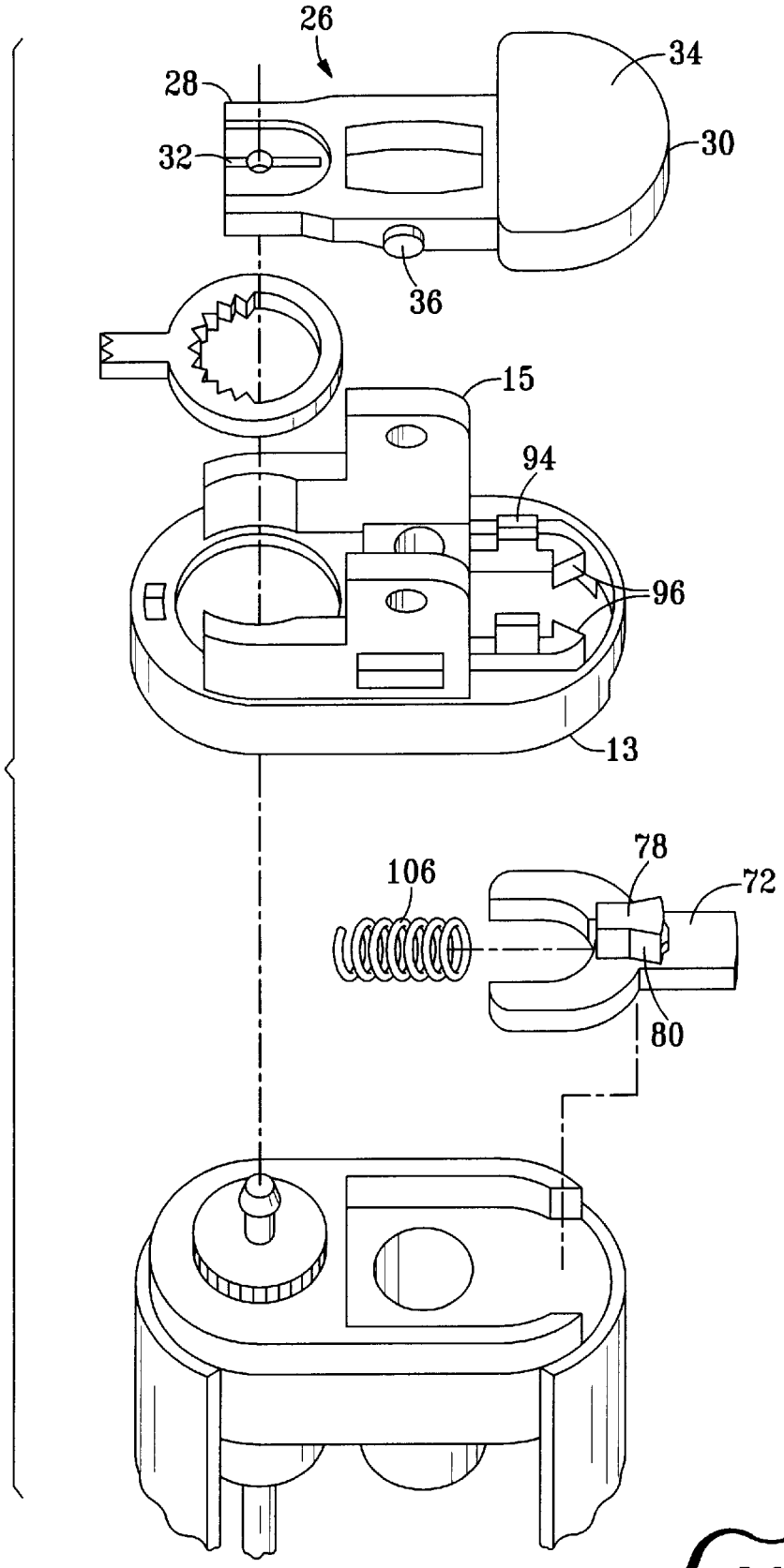
FIG. 9 is an exploded view of the invention.
Figure 10:
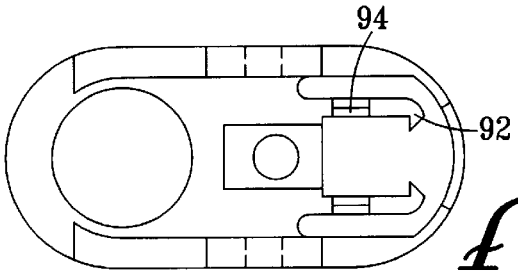
FIG. 10 is top view of a component of the lighter incorporating the push button retention means.
Figure 11:
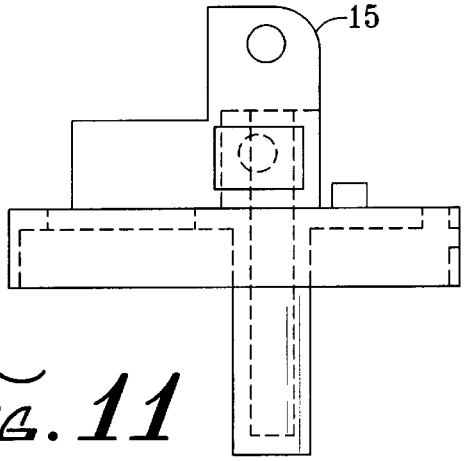
FIG. 11 is a side view of a portion of the lighter housing
Figure 12:
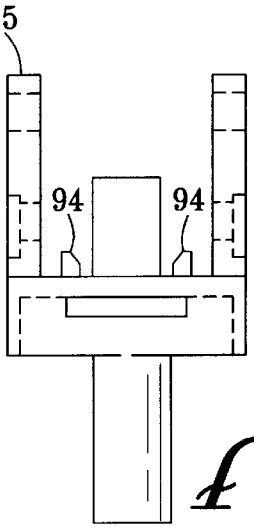
FIG. 12 is a rear view of a portion of the lighter housing.
Figure 13:
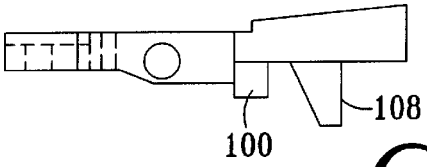
FIG. 13 is a side view of the release arm.
Figure 14:
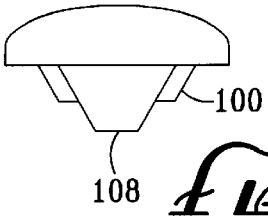
FIG. 14 is a rear view of the release arm.
Figure 15:
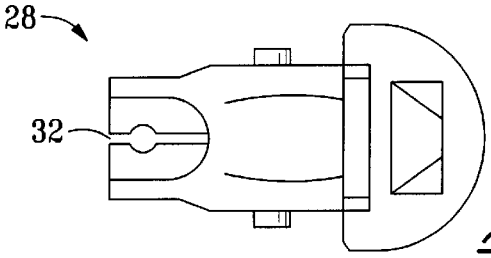
FIG. 15 is a view looking from below of the release arm.

FIGS. 1 and 2 generally illustrate the present invention 10, a child resistant lighter, in one of its preferred embodiments. The lighter 10 includes a lighter housing 12, which contains a standard fuel reservoir 14. The lighter housing 12 also includes a top end 13 from which support arms 15 project longitudinally.

The top end 13 of the lighter 10 also generally has a conventional ignition mechanism secured thereto. As shown in FIGS. 1 through 4, the ignition mechanism includes any standard means for the controlled release of a combustible fuel from a reservoir 14. As shown, in FIGS. 2 and 4, such a fuel release means 20 may include a valve 22 connected to a tube 24 that draws on fuel in the reservoir 14. The valve 22 is typically moved to the open position by operation of a release lever 26. The release lever 26 has an interior end 28 and an exterior end 30. The interior end 28 has a prong 32 formed therein for engaging the valve 22. The exterior end 30 has a finger pad 34 for depressing the lever 26. The release lever 26 also includes hinging means 36 permitting the lever 26 to pivot when in operation. A standard wind screen 38 fits over and encloses the valve 22 and a portion of the support arms 15.

The ignition mechanism also includes a spark wheel assembly 40. The spark wheel assembly 40 includes an axle 42, contact wheels 46, and a strike wheel 48. The strike wheel 48 has a rough surface 50 and is centrally located on the axle 42 so that it is positioned to come in contact with a flint 52. The flint 52 is contained with an elongated receptacle 54 and is biased upward against the strike wheel 48 by a spring 56 positioned below the flint 52 in the receptacle 54. During operation, the strike wheel 48 rotates while in contact with the flint 52. The surface 50 of the strike wheel 48 must have a sufficient coefficient of friction to generate a spark when rotated in contact with the flint 52. Typically, the strike wheel 48 is rigidly fixed to the axle 42 such that it can only rotate if the axle 42 rotates.

The new and novel improvement of the present invention is the addition of a locking push button safety device to the conventional ignition mechanism 16. This push button safety device 58 operates by blocking movement of release lever 26 so that valve 22 can not be opened. This blocking action is performed by placing interference block 78 in the operational pathway of release lever 26. Interference block 78 being mounted to push button 72 so as to be positioned in the operational pathway of release lever 26 when push button 72 is in its initial position and moved completely out of this pathway when push button 72 is translated to its engaged position. As such with push button 72 in its engaged position release lever 26 may be sufficiently deflected to open cooperating valve 22. Also included in locking push button safety device is retention means for receiving and locking push button 72 at it engaged position prior to and during deflection of release lever 26, release means for disengaging retention means, and return means for restraining push button 72 during opening of valve 22 and automatically returning push button 72 to its initial position after closure of valve 22.

Lighter 10 incorporating locking push button safety device operates as a child resistant safety lighter by requiring a user to depress push button 72 to the point that it locks into its engaged position. Only with push button 72 engaged will interference block 78 be motive completely out of the operational pathway of release lever 26 to allow operation of lighter 10. As such, to use lighter 10 a child must have the physical strength and manual dexterity to depress push button 72 to the point of engagement. Further, to understand how to operate locking push button safety device the user must possess a level of mental comprehension greater than that of a,most children. As such, the addition of push button safety device increases the complexity of the operation of the lighter and reduces the likelihood of use by a child.

The locking push button safety device comprises push button 72, interference block 78, retention means, release means, and return means.

Push button 72 is slidably mounted on lighter housing 12 having an initial position and an engaged position. For operation by a user push button 72 is depressed to the engaged position by the finger of a user.

Interference block 78 is mounted and fixed to push button 72 such that interference block 78 will travel with push button 72 between the initial and engaged positions of push button 72. While push button 72 is in its initial position interference block 78 will be placed in The operational pathway of release lever 26 as to prevent movement of release lever 26 sufficient enough to cause the opening of valve 22. However, interference block 78 will also be sized and positioned such that when push button 72 is in its engaged position interference block 78 will have been moved out of the operational pathway of release lever 26 so that release lever 26 may be operated to the extent necessary to open valve 22 and otherwise operator lighter 10.

Retention means being a means for receiving and retaining push button 72 at its engaged position. Retention means is mounted to lighter housing 12 and position so that it is capable of operating with push button 72. More specifically retention means may be in the form of at least one retention prong 84 mounted to lighter housing 12. In its preferred embodiment the retention means include two retention prongs. Each retention prong 84 being shaped to receive and retain push button 72 at its engaged position. Also, each retention prong 84 has deflected and non-deflected positions. With retention prong 84 in its non-deflected position IT is positioned to receive and retain push button 72. Similarly, with each retention prong 84 in its deflected position it will be positioned to release push button 72.

Release means is for activating retention means 82 to cause the release of push button 72 from retention means when release lever 26 is in a position to cause valve 22 to be open. Release means may be in the form of prong actuator 100 and restraining block 108. Prong actuator 100 being mounted onto release lever 26 and positioned in operating relation to retention prong 84 such that as release lever 26 is deflected sufficiently to open valve 22 prong actuator 100 will deflect retention prong 84 to its deflected position and in so doing will cause the release of push button 72 from retention prong 84. Restraining block 108 being positioned and sized to receive and restrain push button 72 when release lever 26 is deflected sufficiently to open said valve 22 and to cause prong actuator 100 to translate retention prong 84 to its deflected position and release push button 72 from retention prong 84 such that push button 72 will slide enough to disengage from retention prong 84 but not far enough to return to its initial position. Further, restraining block 108 is also positioned and sized such that with release lever 26 is in a position where valve 22 is closed and push button 72 is in its initial position, interference block 78 will again be positioned in, the operational pathway of release lever 26.

Return means 102 is for returning push button 72 to its initial position after release of push button 72 by retention means 82 and upon sufficient translation of release level 26 from its position where valve 22 is open to its position where valve 22 is closed. Return means 102 being mounted to lighter housing 12 in operating relation to push button 72.

To operate lighter 10 incorporating locking push button safety device a user must first translate push button 72 from its initial position to its engaged position. This translation can be accomplished by the user applying sufficient force to actuator pad 76 in substantially the same direction as the movement of push button 72 from initial to engaged positions. Once push button 72 has reached its engaged position, retention means will automatically lock push button 72 into place. Now lighter 10 may be used in the same manner as any typically non-child resistent lighter, that is, the user will draw a finger, normally the thumb, across the exposed portion of the spark wheel 40, causing sufficient rotation to produce a spark, and immediately afterward applying said finger to finger pad 34, causing deflection of release lever 26, opening of valve 22, and ignition of released gases. With release lever 26 so deflected, release means will disengage push button 72 and restraining block 108 will receive and hold push button 72. Lighter 10 will continue to operate so long as release lever 26 is deflected sufficiently to keep valve 22 open. Upon release of release lever 26, valve 22 will close causing the flame to be extinguished, retaining block 108 will release push button 72, and return means 102 will move push button 72 back to its initial position causing interference block 78 to once again be placed in the operational pathway of release lever 26.

The preferred embodiment of locking push button safety device is shown in FIGS. 1–15, inclusive, Generally this preferred embodiment comprises push button 72, an interference block 78, return spring 106, and a pair of opposing retention prongs 84.

Push button 72 being slidably mounted on lighter housing 12 below release lever 26. Push button 72 having an initial position, an engaged position, including actuator pad 76 which is sufficiently exposed from lighter housing 12 to allow translation of push button 72 from its initial position to its engaged position upon depression of actuator pad 76 by a user.

Interference block 78 being mounted to push button 72 such that when push button 72 is in its initial position interference block 78 is positioned in the operational pathway of release lever 26. Interference block 78 being sized to prevent sufficient movement of release lever 26 to cause opening of valve 22. Also, interference block 78 is sized and positioned such that when push button 72 is in its engaged position interference block 78 is removed from the operational pathway of release level 26 so that release level 26 may be operated to the extent necessary to open valve 22. Finally, interference block 78 includes opposing beveled surfaces 80 positioned to receive each beveled surface 96 of each catch claw 92. These opposing beveled surfaces 80 facilitate deflection of each retention prong 84 from their respective non-deflected positions to their respective deflected positions.

Return spring 106 being interposed between push button 72 and lighter housing 12 such that return spring 106 will apply a force to push button 72 to return push button 72 to its initial position.

The opposing retention prongs 84 each include a lever arm 90 and a catch claw 92. Each lever arm 90 being mounted at first end 86 to lighter housing 12 and each having catch claw 92 mounted at second end 88 opposite of first end 86. Also included on each retention prong 84 is a separator receiving and guide pad 94 mounted along each lever arm 90 in operational relationship with prong actuator 100 and positioned to receive prong actuator 100 to facilitate the displacement of retention prongs 84. Finally, each catch claw 92 includes a beveled surface 96 positioned where each catch claw 92 initially receive interference block 78. These beveled surfaces are positioned and shaped to facilitate deflection of the retention prongs 84 from their respective non-deflected positions to their respective deflected positions. Further, each retention prong 84 have deflected and non-deflected positions such that in the non-deflected position second end 88 will each be positioned to retain interference block 78 and in deflected position will each be positioned to release interference block 78. Also, each lever arm 90 is comprised of a flexible material to allow deflection between the non-deflected and deflected positions of retention prongs 84. Each catch claw 92 being shaped and oppositely positioned to receive and retain interference block 78 when push button 72 is in its engaged position.

In this preferred embodiment release lever 26 further comprises prong actuator 100 and restraining block 108. Prong actuator 100 being mounted on the [lower surface] of release lever 26 in operating relation to retention prongs 84. As release lever 26 is deflected sufficiently to open valve 22 prong actuator 100 will deflect each retention prong 84 to their respective deflected positions and release interference block 78 from each retention prong 84.

Restraining block 108 is likewise mounted on the [lower surface] of release lever 26 and positioned and sized to receive and restrain interference block 78. When release lever 26 is deflected sufficiently to open valve 22 and to cause prong actuator 100 to translate each retention prong 84 to their respective deflected positions and release interference block 78 from retention prongs 84 such that interference block 78 will slide enough to disengage from each retention prong 84 but not far enough to return to its push button 72 to its initial position. Restraining block 108 being further positioned and sized such that with release lever 26 deflected such that valve 22 is closed and push button 72 in its initial position, interference block 78 will be positioned in the operational pathway of release lever 26.

Although the present invention has been described in considerable detail with reference to certain preferred versions thereof, other versions are possible. For example, return means 102 could employ a non-resilient method of operation, that is, push button 72 could be returned by way of a mechanical linkage attached to release lever 26. Therefore, the spirit and scope of the appended claims should not be limited to the description of the preferred versions contained herein.

What is claimed is:

1. A child-resistant lighter having a lighter housing defining a reservoir for containing a combustible fuel, a fuel release means in communication with said reservoir, a valve means cooperating with a release lever for selective actuation between a normally closed valve position which prevents exit of said combustible fuel from said reservoir, and an open position which permits exit of combustible fuel from said reservoir through said valve means, said release lever having an operational pathway traversing between positions where said cooperating valve is closed and where said cooperating valve is open, said release lever including a thumb pad for actuation of said lever by a user, an axle rotatably engaging a set of support arms projecting from said lighter housing, a strike wheel having a radius and fixed about said axle for interacting with a flint biased against said strike wheel, the improvement comprising:

a push button being slidably mounted on said lighter housing, said push button being located either in an initial position or an engaged position, a first end with an actuator pad sufficiently exposed from said lighter housing to allow translation between said initial position and said engaged position upon depression of said actuator by a user, an interference block being mounted to said push button such that when said push button is in its initial position said interference block is positioned in the operational pathway of said release lever, said interference block being sized to prevent sufficient movement of said release lever to cause opening of said valve, said interference block being sized and positioned such that when said push button is in its engaged position said interference block is removed from the operational pathway of said release lever so that said release lever may be operated to the extent necessary to open said valve, means for returning said push button to its initial position being interposed between said push button and said lighter housing such that said returning means applies a force to said push button and cause said push button to return to its initial position, wherein said returning means is a spring, a retention prong being mounted at a first end to said lighter housing and at a second end opposite of the first end being shaped to receive and retain said push button at its engaged position, said retention prong further having deflected and non-deflected positions such that in said non-deflected position said second end will be positioned to retain and receive said push button and in said deflected position said second end will be positioned to release said push button; wherein the retention prong comprises two said retention prongs, each retention prong being positioned opposing the other and sized to mutually receive and retain said interference block, wherein said retention prongs each have a lever arm and a catch claw, said lever arm being mounted at a first end to said lighter housing and having said catch claw mounted at a second end opposite of the first end, said lever arm being comprised of a flexible material to allow deflection between the non-deflected and deflected positions of said retention prongs, said catch claw being shared and positioned to receive and retain said interference block when said push button is in its engaged position, a release lever further comprising a prong actuator and a restraining block, a prong actuator being positioned in operating relation to said retention prong such that as said release lever is deflected sufficiently to open said valve said prong actuator will deflect said, retention prong to its deflected position and release said push button from said retention prong, a restraining block being positioned and sized to receive and restrain said push button when said release lever is deflected sufficiently to open said valve and to cause said prong actuator to translate said retention prong to its deflected position and release said push button from said retention prong such that said push button will slide enough to disengage from said retention prong but not far enough to return to its initial position, said restraining block being further positioned and sized such that with said release lever deflected such that said valve is closed and said push button in its initial position, said interference block will be positioned in the operational pathway of said release lever.

2. A child-resistant lighter as in claim 1 wherein said retention prongs each further comprises a separator receiving and guide pad mounted along said lever arms in operational relationship with said separator positioned to receive said separator to facilitate displacement of said retention prongs.

3. A child-resistant lighter having a lighter housing defining a reservoir for containing a combustible fuel, a fuel release means in communication with said reservoir, a valve means cooperating with a release lever for selective actuation between a normally closed valve position which prevents exit of said combustible fuel from said reservoir, and an open position which permits exit of combustible fuel from said reservoir through said valve, said release lever having an operational pathway traversing between positions where said cooperating valve is closed and where said cooperating valve is open, said release lever including a thumb pad for actuation of said lever by a user, an axle rotatably engaging a set of support arms projecting from said lighter housing, a strike wheel having a radius and fixed about said axle for interacting with a flint biased against said strike wheel, the improvement comprising:

a push button being slidably mounted on said lighter housing below said release lever, the push button is located either in an initial position or an engaged position, the push button having a first end with an actuator pad sufficiently exposed from said lighter housing to allow translation between said initial position and said engaged position upon depression of said actuator pad by a user, an interference block being mounted to said push button such that when said push button is in its initial position said interference block is positioned in the operational pathway of said release lever, said interference block being sized to prevent sufficient movement of said release lever to cause opening of said valve, said interference block being sized and positioned such that when said push button is in its engaged position said interference block is removed from the operational pathway of said release lever so that said release lever may be operated to the extent necessary to open said valve, a return spring being interposed between said push button and said lighter housing such that said return spring applies a force to said push button to return said push button to its initial position, opposing retention prongs each being mounted at a first end to said lighter housing and at a second end opposite of the first end being shaped to mutually receive and retain said push button in its engaged position, said retention prongs each further having deflected and non-deflected positions such that in said non-deflected position said second end will each be positioned to retain said push button and in said deflected position will each be positioned to release said push button;

said release lever further comprising a prong actuator and a restraining block, said prong actuator being mounted on the lower surface of said release lever in operating relation to said retention prongs such that as said release lever is deflected sufficiently to open said valve said prong actuator will deflect each said retention prong to its deflected position and release said push button from each said retention prong, said restraining block being mounted on the lower surface of said release lever and positioned and sized to receive and restrain said push button when said release lever is deflected sufficiently to open said valve and to cause said prong actuator to translate each of said retention prongs to the deflected positions and release said push button from said retention prongs such that said push button will slide enough to disengage from each said retention prong but not far enough to return to its initial position, said restraining block being further positioned and sized such that with said release lever deflected such that said valve is closed and said push button in its initial position, said interference block will be positioned in the operational pathway of said release lever.

4. A child-resistant lighter as in claim 3 wherein each said retention prong is positioned and sized to receive and retain said interference block.

5. A child-resistant lighter as in claim 4 wherein said retention prongs each have a lever arm and a catch claw, each said lever arm being mounted at a first end to said lighter housing and each having said catch claw mounted at a second end opposite of the first end, each said lever arm being comprised of a flexible material to allow deflection between the non-deflected and deflected positions of said retention prongs, each said catch claw being shaped and oppositely positioned to receive and retain said interference block when said push button is in its engaged position.

6. A child-resistant lighter as in claim 5 wherein said retention prongs each further comprises a separator receiving and guide pad mounted along said lever arms in operational relationship with said prong actuator positioned to receive said prong actuator to facilitate displacement of said retention prongs.

7. A child-resistant lighter as in claim 6 wherein said retention prongs each further comprises a beveled surface on the catch claw where each said catch claws initially receive said interference block to facilitate deflection of each said retention prong from its non-deflected position to its deflected position.

8. A child-resistant lighter as in claim 7 wherein said interference block further comprises opposing beveled surfaces positioned to receive each said beveled surface of each said catch claw to facilitate deflection of each said retention prong from its non-deflected position to its deflected position.

* * * * *